US007082808B2

(12) United States Patent
Knaup

(10) Patent No.: US 7,082,808 B2
(45) Date of Patent: Aug. 1, 2006

(54) MAKING PLATE WORKPIECE WITH REGIONS OF DIFFERENT THICKNESS

(75) Inventor: Hans-Jürgen Knaup, Bad Lippspringe (DE)

(73) Assignee: Benteler Automobil Technik Gmbh, Paderborn (DE)

( * ) Notice: Subject to any disclaimer, the term of this patent is extended or adjusted under 35 U.S.C. 154(b) by 149 days.

(21) Appl. No.: 10/766,513

(22) Filed: Jan. 27, 2004

(65) Prior Publication Data

US 2004/0216505 A1 Nov. 4, 2004

(30) Foreign Application Priority Data

Jan. 28, 2003 (DE) ..... 103 03 184

(51) Int. Cl.
*B21D 22/00* (2006.01)

(52) U.S. Cl. ..... 72/352; 72/356; 72/358; 72/364; 72/377; 72/361

(58) Field of Classification Search ..... 72/351, 72/352, 353.2, 353.6, 354.2, 355.4, 356, 72/358, 359, 353.4, 354.8, 355.6, 461, 377, 72/354.6, 370.14, 370.15, 370.16, 370.17, 72/370.18, 347, 344, 361; 29/890.141, 34 R
See application file for complete search history.

(56) References Cited

U.S. PATENT DOCUMENTS

| | | | | |
|---|---|---|---|---|
| 4,113,522 | A * | 9/1978 | Hamilton et al. | 72/358 |
| 4,346,581 | A * | 8/1982 | Ando | 72/347 |
| 4,571,977 | A * | 2/1986 | Ueno et al. | 72/342.94 |
| 6,145,365 | A | 11/2000 | Miyahara | |
| 2002/0157444 | A1* | 10/2002 | Heussen et al. | 72/356 |
| 2003/0196468 | A1* | 10/2003 | Ando et al. | 72/353.2 |

FOREIGN PATENT DOCUMENTS

| | | |
|---|---|---|
| DE | 42 31 213 | 3/1994 |
| DE | 100 63 040 | 6/2002 |

* cited by examiner

*Primary Examiner*—Dmitry Suhol
(74) *Attorney, Agent, or Firm*—Andrew Wilford

(57) ABSTRACT

A method of making a part with regions of different thickness from a plate workpiece having a pair of substantially parallel plate faces. The workpiece is fitted between a surface of a die and a substantially parallel surface of a punch. The die is formed at its surface with an opening. Then the die and the punch are relatively shifted parallel to the surfaces and faces and so as to compress the workpiece parallel to its faces to extrude the workpiece transversely into the opening in the die surface, thereby creating a region of greater thickness.

11 Claims, 4 Drawing Sheets

MAKING PLATE WORKPIECE WITH REGIONS OF DIFFERENT THICKNESS

FIELD OF THE INVENTION

The present invention relates to the manufacture of a plate workpiece with regions of different thickness. More particularly this invention concerns a method of and apparatus for making a motor vehicle part regions of reduced thickness so as to reduce weight and regions of considerable thickness for strength.

BACKGROUND OF THE INVENTION

In the production of various construction elements, for instance the A-, B-, and C-columns in a motor vehicle as well as in shock absorbers and their support struts, roof beams, side frame elements, and spring arms it is often desirable for the element to have regions of different thickness. The thicker regions provide strength where needed while the thinner regions make the part as light as possible.

At one time this was most simply accomplished by laminating together metal plates as so-called tailored blanks. Such construction is difficult and delamination is always a problem leading to failure of the part.

Accordingly German 4,231,213 of R. Hansen et al proposes making the part from a flat plate having a starting thickness equal to the thickest part of the finished workpiece. The thick plate is deformed and machined so that its thickness is reduced everywhere except where it needs to be thick. Such a system is difficult because the thin regions of often account for most of the area of the workpiece, so the work reducing all this area to the desired thickness is considerable.

In another system described in German 100 63 040 of H. Knaup a car part is made by compressing a workpiece to form a bump in it, then the workpiece is machined at the bumps to reduce its thickness. Such a system uses a great deal of material, in act reducing much of the workpiece to chips or powder. In addition it requires multiple steps, deforming and machining for instance, to create the desired end product. It is extremely inefficient for the production of a workpiece only a small portion of which needs to be thick.

OBJECTS OF THE INVENTION

It is therefore an object of the present invention to provide an improved method and apparatus for making a workpiece with regions of different thickness.

Another object is the provision of such an improved method and apparatus for making a workpiece with regions of different thickness which overcome the above-given disadvantages, that is which is a simple one-step operation that wastes little or none of the material of the starting blank.

SUMMARY OF THE INVENTION

A method of making a part with regions of different thickness from a plate workpiece having a pair of substantially parallel plate faces. According to the invention the workpiece is fitted between a surface of a die and a substantially parallel surface of a punch. The die is formed at its surface with an opening. Then the die and the punch are relatively shifted parallel to the surfaces and faces and so as to compress the workpiece parallel to its faces to extrude the workpiece transversely into the opening in the die surface, thereby creating a region of greater thickness. Normally the punch is moved relative to the die, although it is within the scope of the invention to hold the punch stationary and move the die, or move both the punch and the die.

Thus with the system of this invention, rather than reducing the workpiece thickness where the finished part is supposed to be thin, the thickness in increased where it needs to be thick. Since normally a part has to be thick in a few locations, the inventive method is substantially simpler and easier than the prior-art methods. No material is lost from the workpiece, so it is very efficient in this regard. The die can have several openings so that the workpiece is thickened in several locations, but in any case the workpiece has a starting thickness that in the same as the thinnest regions of the finished part. The finished part can have, for instance, a thickened annular edge and one or more thickened regions forming stiffening ribs extending across it. A flange can be formed on one part of a workpiece. It is possible to produce a finished part of a shape that could not be made by standard through-die extrusion or rolling.

The plate faces are in full surface contact with the die and punch surfaces except at the opening. In addition the die surface is smother than the punch surface so that the workpiece sticks to the punch and slides on the die because the coefficient of friction between the plate and the die is less than that between the plate and the punch.

The plate can be thickened according to the invention immediately after being cut. Thus it passes directly from an automatic plate cutting machine to a thickening apparatus carrying out the method of this invention.

It is further possible according to the invention to heat the plate workpiece before fitting it to the die and punch. This can be done by providing a heater right in the die and/or punch. Alternately the workpiece can be heated in an oven and then immediately subjected to the compression/thickening step of this invention. Hardening can take right in the thickening apparatus so the finished part has an exactly determined shape.

The part according to the invention is very strong since the crystalline structure of the metal, normally steel or aluminum, is continuous at the margins of the thickened regions. In fact the grain structure has a shape conforming to the exterior surface, not the broken one produced by machining away the workpiece at the thin regions. As a result when the part is used in a motor vehicle it has excellent crash resistance, that is will retain strength even in an accident when it is severely stressed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
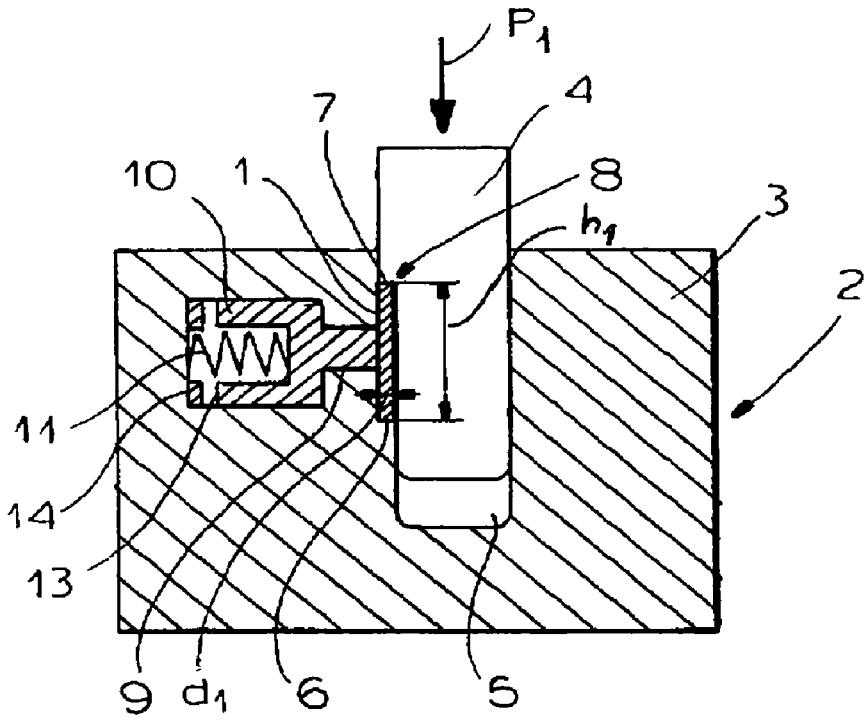
FIGS. 1 and 2 are schematic sectional views illustrating the method and apparatus of this invention before and after shaping a workpiece.
Figure 2:
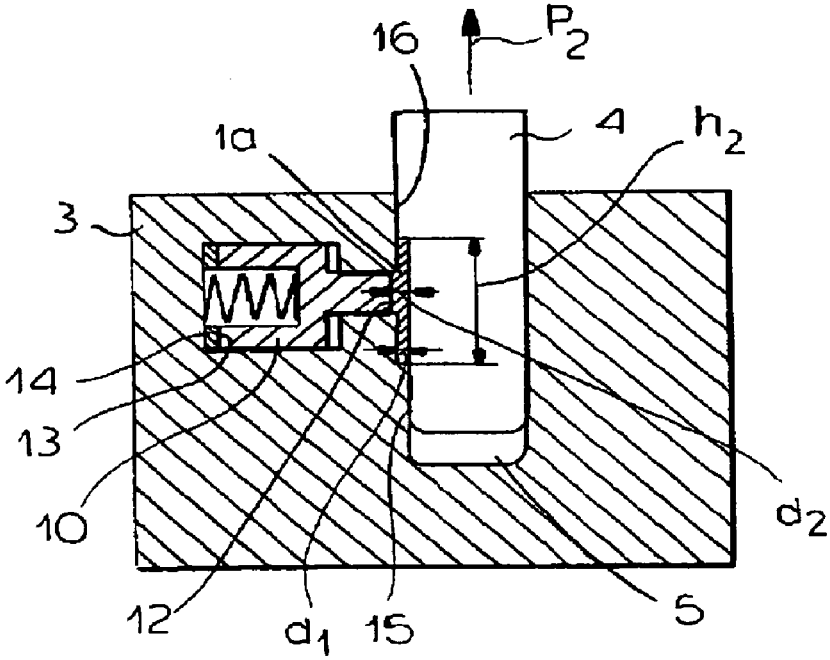

As seen in FIGS. 1 and 2 a plate workpiece 1 is held in a forming apparatus 2 comprised of a stationary die 3 formed with a square-section cavity 5 in which a punch 4 can slide in parallel directions $P_1$ and $P_2$. One planar interior surface 16 of the cavity 5 is set back and forms a shoulder 6 directed backward in the direction $P_2$ and a confronting planar surface 15 of the punch 4 is cut back to form a shoulder 7 confronting the shoulder 6. The punch 4 fits complementarily in the cavity 5 and is only spaced from it at the surfaces 15 and 16 between the shoulders 6 and 7 in a rectangular region having a constant depth $d_1$ measured transverse to the directions $P_1$ and $P_2$ equal to the thickness of a plate-shaped metal blank 1.

The shoulders 6 and 7 are planar and can be perpendicular to the directions $P_1$ and $P_2$ but preferably are canted at a slight angle thereto so that they converge outward away from the punch 4. The punch surface 15 is roughened to increase friction forward, that is downward in the drawing from the shoulder 7 but the confronting surface 16 of the cavity 5 upward of the shoulder 6 is machined smooth.

In addition the die 3 is provided with an abutment 10 having a planar face exposed in the cavity 5 and displaceable perpendicular to the directions $P_1$ and $P_2$ in a passage 9 away from the cavity 5 against the force of a powerful compression spring 11. A pressurized hydraulic fluid could replace the spring 11. A stop or spacer 14 is provided in the die 13 for engagement with a rear face 13 of the abutment 10 to limit its movement away from the cavity 5.

In use the punch 4 is pulled completely out of the die 3. Then the punch 4 is fitted to the cavity 5 with its shoulder spaced retracted far enough to space its shoulder 7 outside the die 3 by a distance equal to at least a length or height $h_1$ of the plate 1 measured parallel to its plane. The punch 4 is pushed downward in the direction $P_1$ until the leading edge of the plate 1 engages the shoulder 6. Further force applied in the direction $P_1$ will longitudinally compress the plate 1 into a workpiece 1*a* which deforms outward into the passage 9, pressing back the abutment 10 against the force of its spring 11 until it seats against the stop 14. During this compression, which is applied longitudinally and causes the workpiece to extrude transversely, the back face of the workpiece plate 1 is in full surface contact with the rough surface 15 of the punch 4. This forms a bump 12 on the workpiece 1*a* having a shape corresponding to that of the passage 9, the bump 12 having a planar end face like the end of the abutment 10. The finished workpiece has a height $h_2$ that is less than the height $h_1$. The Blight canting of the two edges or shoulders 6 and 7, the roughness of the punch surface 15, and the smoothness of the surface 16 ensure that the workpiece 1 will slide along the die 3 and lie flat against the punch 4.

Figure 3:
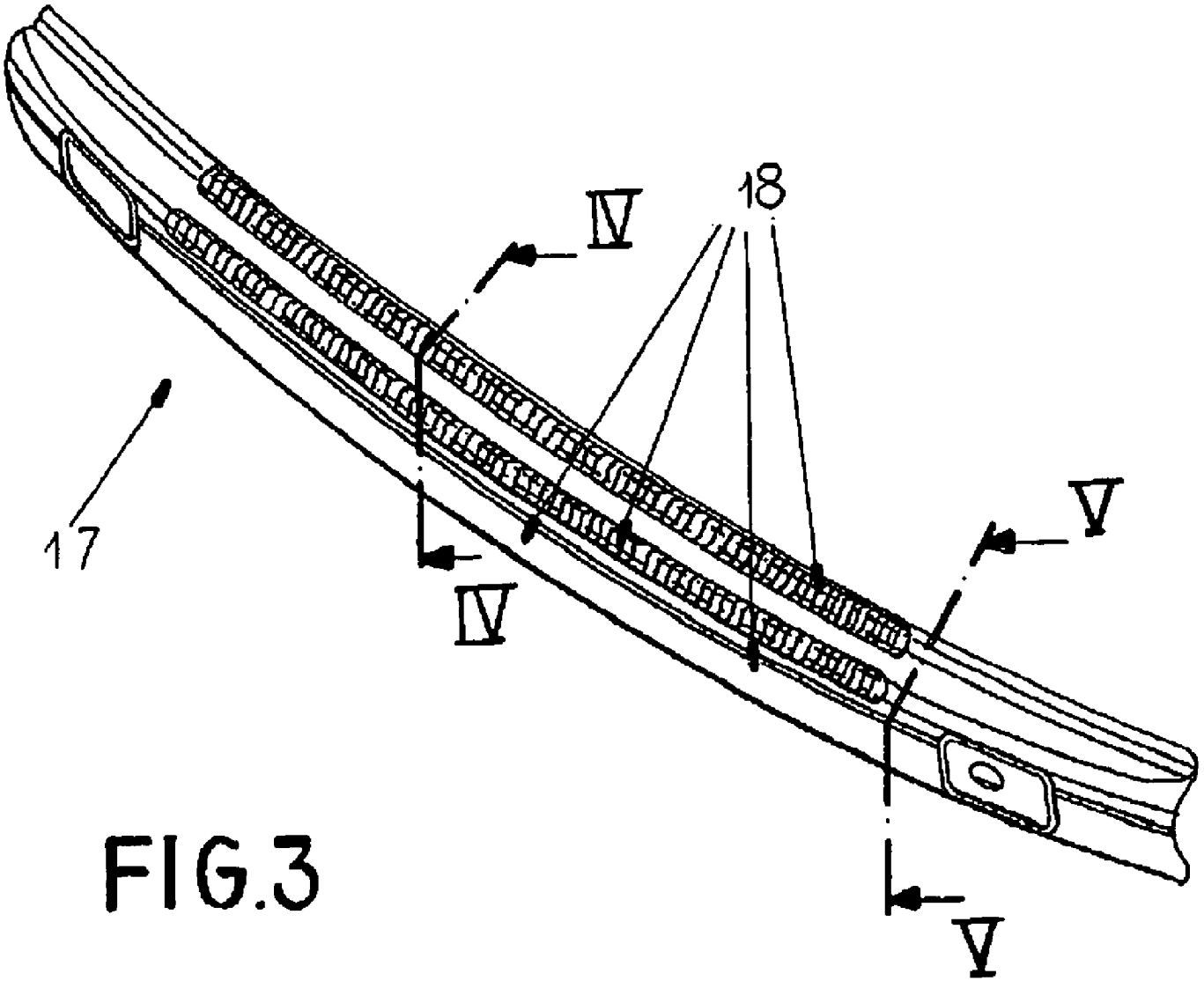
FIG. 3 is a perspective view of a finished workpiece according to the invention.
Figure 5:
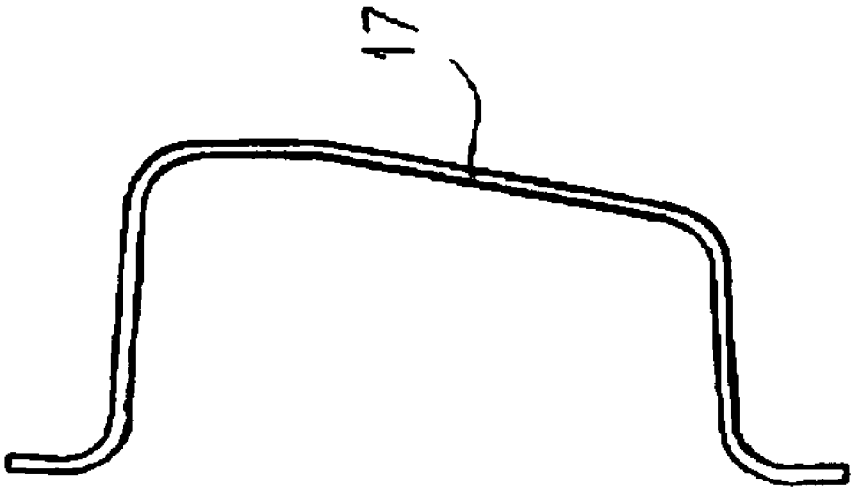
FIGS. 4 and 5 are cross sections taken along lines IV—IV and V—V of FIG. 3.
Figure 4:
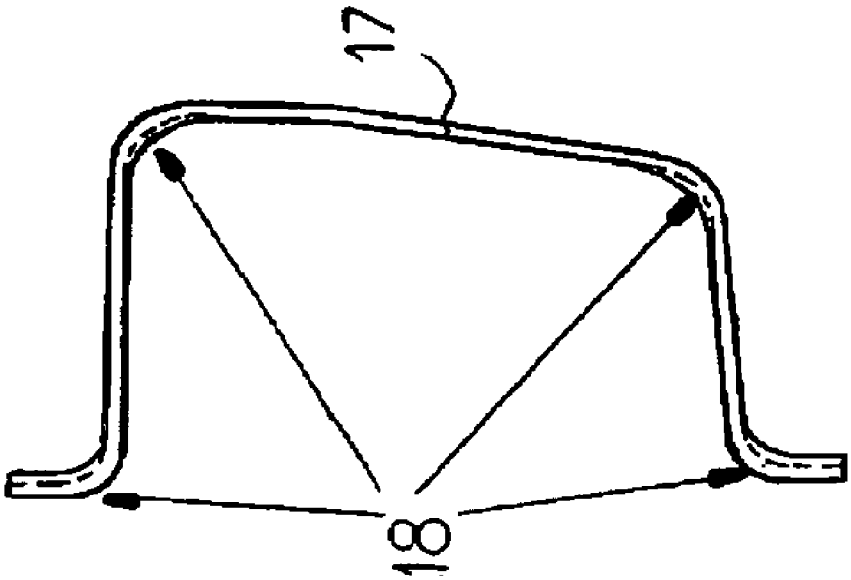

FIGS. 3, 4, and 5 show how this system can be applied to a workpiece 17 to provided it with central thickened regions 18. These thickenings increase strength at critical corner and edge regions, while the rest of the workpiece 17 is left thin so that it is quite light.

Figure 6:
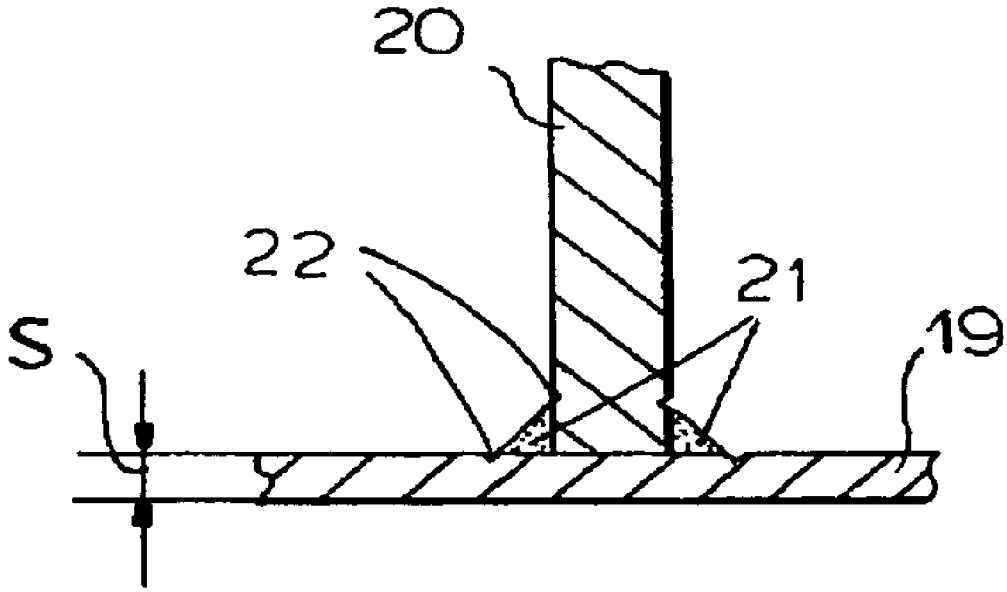
FIG.6 PRIOR ART
FIG. 6 is a large-scale section through a prior-art weld joint.
Figure 7:
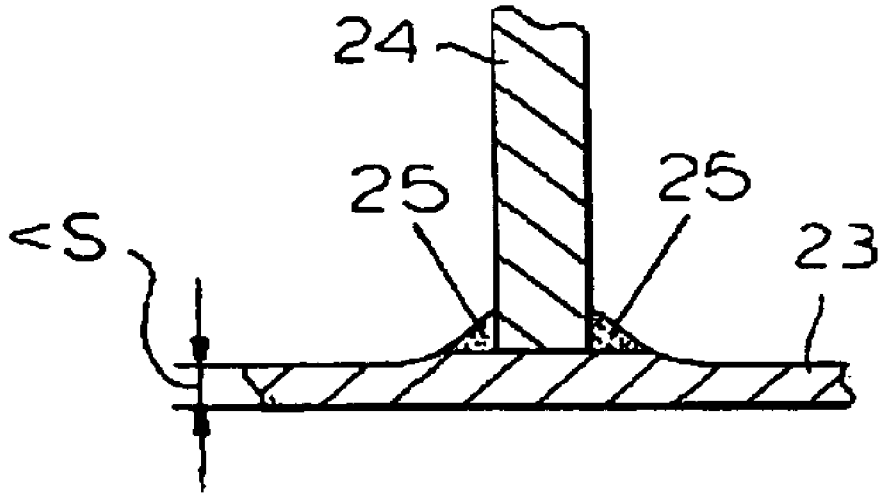
FIG. 7 is a view like FIG. 6 but using a workpiece according to the invention.

FIG. 6 shows how in the prior art two plates 19 and 20 are welded together at 21. This action erodes the plates 19 and 20 at 22 reducing plate thickness s and thereby weakening the plate 19 locally.

According to the invention a similar weld at 25 between two plates 23 and 24 is effected where the plate 23 has been thickened so that no thickness is lost.

I claim:

1. A method of making a part with regions of different thickness from a plate workpiece having a pair of substantially parallel plate faces, the method comprising the steps of:

fitting the workpiece between a longitudinally extending surface of a die and a substantially parallel surface of a punch and between longitudinally confronting and transversely extending shoulders of the die and punch with the workpiece faces lying flatly against the punch and die surfaces and end edges of the workpiece against the punch and die shoulders, the die being formed at its surface with an opening;

relatively shifting the die and the punch to move the respective shoulders longitudinally together parallel to the surfaces and faces and thereby longitudinally compressing the workpiece to extrude the workpiece transversely into the opening in the die surface while bracing the workpiece transversely against the punch surface.

2. The method defined in claim 1 wherein the plate faces are in full surface contact with the die and punch surfaces except at the opening.

3. The method defined in claim 1 wherein the die surface is smoother than the punch surface, whereby the workpiece sticks to the punch and slides on the die.

4. The method defined in claim 1, further comprising the step of heating the plate workpiece before fitting it to the die and punch.

5. The method defined in claim 4 wherein the workpiece is heated while fitted to the die and punch after compression.

6. The apparatus defined in claim 1 wherein the plate workpiece is of metal.

7. The apparatus defined in claim 6 wherein the metal is aluminum or steel.

8. An apparatus for making a part with regions of different thickness from a plate workpiece having a pair of substantially parallel plate faces, the apparatus comprising:

a die having a generally planar die surface and formed at the surface with an opening;

a punch having a generally planar punch surface parallel to and spaced from the die surface, the workpiece being fittable between the surfaces with its faces in full surface contact with the surfaces, the punch and die having shoulders projecting generally perpendicular to the respective surfaces and engageable with opposite end edges of the plate workpiece;

means for relatively shifting the punch and die relative to each other parallel to the punch and die surfaces and thereby compressing the workpiece to extrude the workpiece into the opening in the die surface while bracing the workpiece in surface contact against the die surface;

an abutment shiftable in the die transversely to the surfaces in the opening and having an end face movable between an advanced position generally flush with the die surface and a retracted position offset back from the die surface; and means for urging the abutment into the flush position.

9. The apparatus defined in claim 8 wherein the die and punch surfaces are spaced apart by a distance equal substantially to a thickness of the plate workpiece.

10. The apparatus defined in claim 8 wherein the urging means is a spring.

11. A method of making a part with regions of different thickness from a plate workpiece having a pair of substantially parallel plate faces, the method comprising the steps of:

fitting the workpiece between a smooth surface of a die and a substantially parallel rough surface of a punch, the die being formed at its surface with an opening; and a relatively shifting the die and the punch parallel to the surfaces and faces and thereby compressing the workpiece to extrude the workpiece into the opening in the die surface while bracing the workpiece against the punch surface, whereby the workpiece sticks to the rough surface of the punch and slides on the smooth surface of the die.

* * * * *